US006191389B1

(12) United States Patent
Rickert, Jr.

(10) Patent No.: US 6,191,389 B1
(45) Date of Patent: Feb. 20, 2001

(54) GREASE RESISTANT OVEN GRILLE

(75) Inventor: Milton Edward Rickert, Jr., Westport, KY (US)

(73) Assignee: General Electric Company, Louisville, KY (US)

( * ) Notice: Under 35 U.S.C. 154(b), the term of this patent shall be extended for 0 days.

(21) Appl. No.: 09/540,835

(22) Filed: Mar. 31, 2000

(51) Int. Cl.[7] ..... F27D 1/12; F27D 7/04; F24C 15/20; F24C 15/32

(52) U.S. Cl. ..... 219/400; 126/299 R; 126/21 A; 219/391

(58) Field of Search ..... 219/391, 392, 219/400; 126/299 R, 299 D, 299 E, 21 A, 193, 198, 300; 427/243, 244, 402, 155, 384

(56) References Cited

U.S. PATENT DOCUMENTS 3,096,207 * 7/1963 Cohen ..... 427/384
4,097,297 * 6/1978 Keene ..... 106/169.14
5,271,959 * 12/1993 Bober et al. ..... 427/155
5,809,993 * 9/1998 Neitzel et al. ..... 126/299 R
5,886,330 3/1999 Kang et al. .

* cited by examiner

*Primary Examiner*—Joseph Pelham
(74) *Attorney, Agent, or Firm*—H. Neil Houser; George L. Rideout, Jr.

(57) ABSTRACT

A grease resistant oven grille includes an injection molded plastic structure having a plurality of air passages therethrough and a grease resistant powder coating layer overlying the plastic structure for withstanding oven exhaust of about 275° F. (135° C.) without color change. The grease resistant powder is a polyester resin that is electrostatically applied to the plastic structure after priming the grille with a conductive primer.

23 Claims, 3 Drawing Sheets

GREASE RESISTANT OVEN GRILLE

BACKGROUND OF THE INVENTION

This invention relates generally to ovens, and more particularly to exhaust ventilation grilles for range applications.

Conventional ovens are either, for example, microwave or radiant cooking type ovens. A microwave oven includes a magnetron for generating RF energy used to cook food in the oven cooking cavity, and radiant cooking ovens include an energy source such as lamps which generate light energy used to cook the food. Although microwave ovens cook food more quickly than radiant ovens, microwave ovens do not brown the food. Radiant ovens brown the food and generally can be used to cook a wider variety of foods than microwave ovens. Therefore, combination ovens have been developed that include both radiant and microwave heating elements to cook a wider variety of foods more quickly.

An oven ventilation system is required for intake of room air into the cooking cavity for cooking operations, and/or for cooling of radiant cooking units, and re-circulation of air back into the room. In some types of ovens, air intake and exhaust is accomplished through ventilation grilles attached to an outer shell of the oven. Due to its low cost and manufacturing versatility, plastic has become a material of choice for oven grilles, and in some cases is used to form decorative grilles on a front face of the oven that add to the aesthetic appeal of the oven.

However, it has been observed that high exhaust temperatures, which may reach 275° F. (135° C.) or greater in a combination oven, and/or grease deposits from cooking cavity exhaust air, adversely affect known plastic grilles of ovens. Resultant grease stains and discoloration of the plastic grilles is highly undesirable. While known plastics exist that maintain grease resistance at elevated temperatures these materials are unacceptable in other aspects, such as UV color stability.

Accordingly, it would be desirable to provide a grease resistant, color stable, plastic oven grille that may withstand severe conditions when used on an oven.

BRIEF SUMMARY OF THE INVENTION

In an exemplary embodiment of the invention, an oven grille includes an injection molded plastic structure having a plurality of air passages therethrough and a grease resistant powder coating layer overlying the plastic structure for withstanding oven exhaust of about 275° F. (135° C.) without color change. The powder coating is a highly cross-linked thermosetting polyester/urethane that is electrostatically applied to the plastic structure over a conductive primer layer having a dry film thickness of about 0.7 mils to about 1.5 mils (17.8 $\mu$m to 38.1 $\mu$m).

The powder coating insulates the plastic structure, resists oxidation and grease penetration, and is color stable to ultraviolet light, thereby enduring high temperature and grease conditions without blemish. The grille may be fabricated in a variety of colors and may be used on a variety of ovens with superior performance relative to known oven grilles.

DETAILED DESCRIPTION OF THE INVENTION

The present invention is directed, in one aspect, to an oven that includes at least two types of cooking elements, such as radiant and microwave cooking elements. Although one specific embodiment of a radiant/microwave cooking oven is described below, it should be understood that the present invention can be utilized in combination with many other ovens and is not limited to practice with the oven described herein. For example, the oven described below is an over the range type oven. The present invention, however, is not limited to practice with just over the range type ovens and can be used with many other types of ovens.

Figure 1:
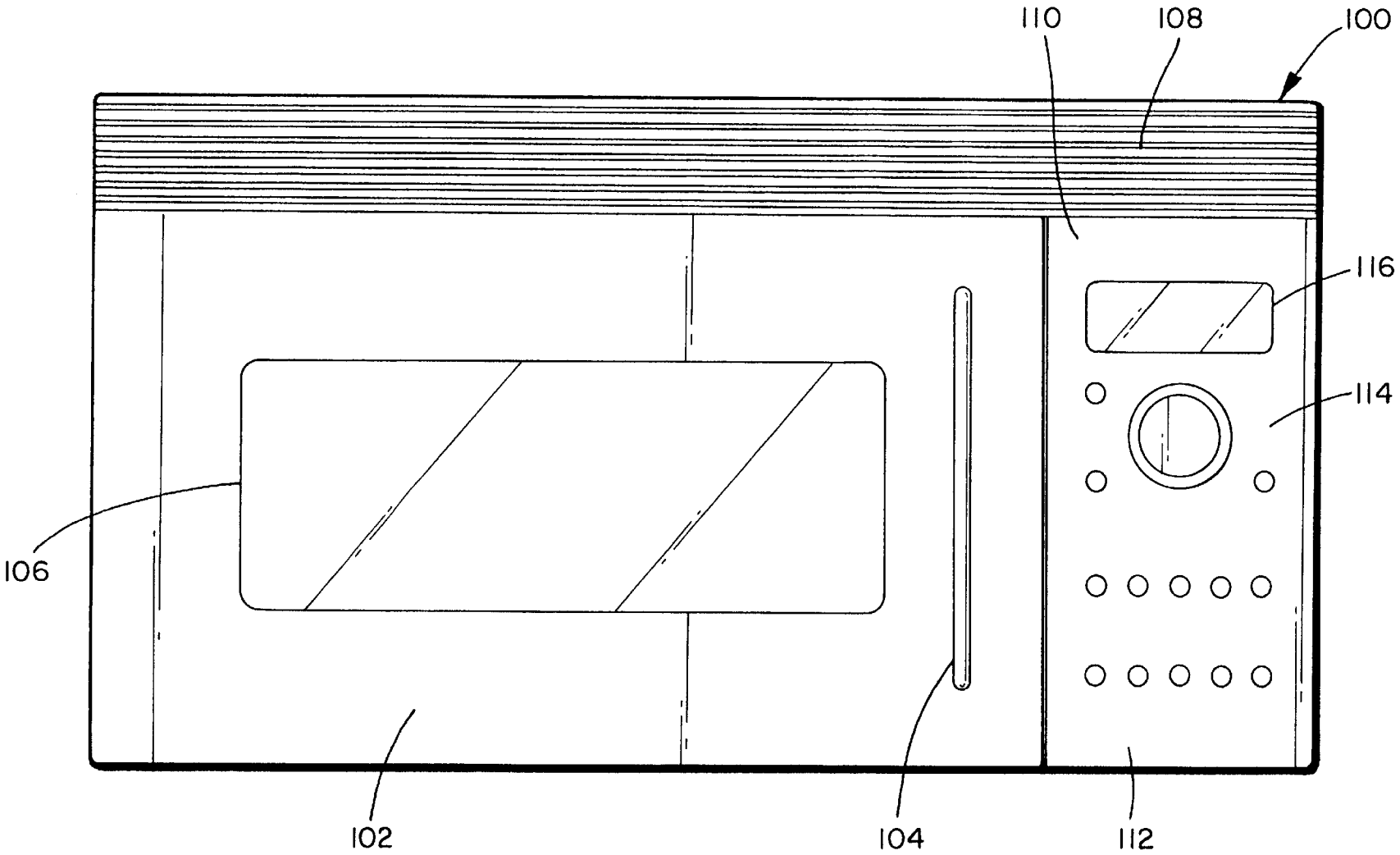
FIG. 1 is a front view of an exemplary oven including a grease-resistant oven grille.

FIG. 1 is a front view of an over the range type oven 100 in accordance with one embodiment of the present invention. Oven 100 includes a frameless glass door 102 having an injection molded handle 104. A window 106 is provided for visualizing food in the oven cooking cavity. Door 102 has an inner metal frame that extends around the door periphery and comprises an RF door choke. The glass of door 102 has, for example, a thickness of about ⅛" and can withstand high temperatures, as is known in the art, and is secured to the inner metal frame by an adhesive. Handle 104 also is secured to the metal frame by bolts that extend through openings in the glass. Oven 100 also includes an injection molded, grease resistant plastic vent grille 108 and a frameless glass control panel 110.

Rubber tactile switch covers 112 are located over each key pad of panel 110, and an injection molded knob or dial 114 is provided for making multiple selections. Selections are made using dial 114 by rotating dial 114 clockwise or counter-clockwise and when the desired selection is displayed, pressing dial 114. Instructions and selections are displayed on a liquid crystal display 116.

Figure 2:
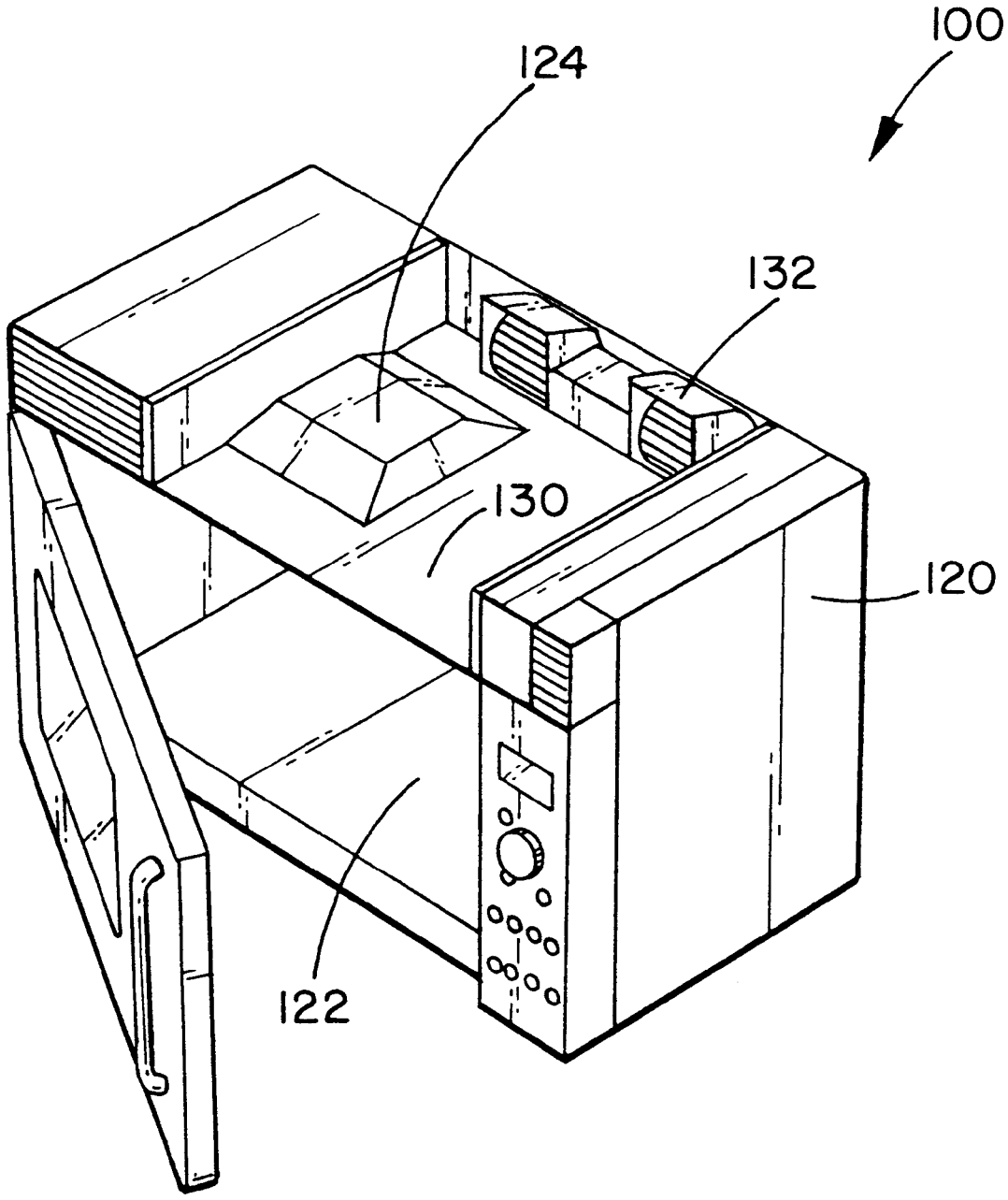
FIG. 2 is a perspective schematic view partially broken away of the oven shown in FIG. 1.

FIG. 2 is a perspective view of a portion of oven 100. Oven 100 includes a shell 120, and a cooking cavity 122 is located within shell 120. Cooking cavity 122 is constructed using high reflectivity (e.g., 72% reflectivity) stainless steel. An upper radiant cooking unit 124 is mounted to an upper panel 130 of shell 120. In one embodiment, a lower radiant cooking unit (not shown) is located at a lower section of shell 120. An exhaust system 132 also is mounted to shell 120, and a cooling system (not shown) is mounted to shell 120 for cooling oven components. Exhaust air is discharged from exhaust system 132 over shell upper panel 130 above cooking cavity and through vent grille 108 into a room where oven 100 is located.

Figure 3:
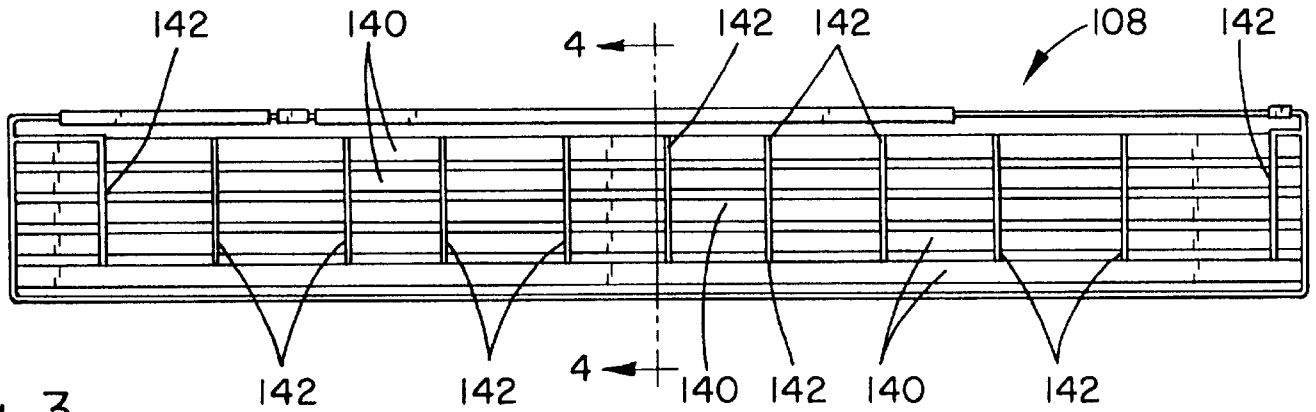
FIG. 3 is a front elevational view of the grille shown in FIG. 1.
Figure 4:
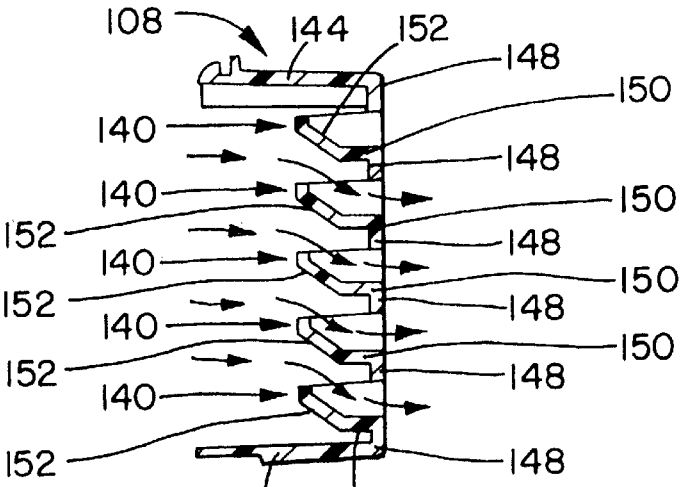
FIG. 4 is a cross-sectional view of the grille taken along line 4—4 of FIG. 3.

FIG. 3 is an elevational view of vent grille 108 including louvers 140 extending between cross members 142 extending substantially perpendicularly to louvers 140. FIG. 4 is a cross-sectional view of grille 108 including a top surface, 144 a bottom surface 146, and a plurality of louvers 140. Each louver 140 contains a face 148, an inner extension 150 extending substantially perpendicular from each face 148, and an inclined section 152 extending obliquely from each of inner extensions 150. In use, exhaust air flows from exhaust system 132 (shown in FIG. 2) and is substantially channeled between inclined sections 152 of adjacent louvers 140 to exit grille 108 in a substantially parallel flow to inner extensions 150 of louvers 140, as indicated by the arrows in FIG. 3.

In a particular embodiment, grille 108 is fabricated from injected molded plastic, such as white VALOX 815 or neutral VALOX 412, both commercially available from General Electric Company. The plastic is injection molded according to known techniques to form a plastic structure including air passages therethrough, such as with louvers 140. To withstand exhaust temperatures between about 260° F. to about 325° F. (127° C. to 163° C.) or more, and further to withstand grease stains and discoloration from heat and grease exposure of about 24 hours to about 200 hours at those temperatures, exterior surfaces of grille 108 are primed and powder coated as described in detail below. The powder coating insulates grille surfaces, resists oxidation and grease penetration, and is color stable to ultraviolet light at elevated temperatures relative to known oven grilles, thereby extending a useable lifespan of plastic grille 108.

After injection molding operations, grille 108 is hung on a conveyor jig (not shown), blown with air, and wiped down with a tac rag. A conductive primer, such as, for example, PPG RPP9850 BCF commercially available from PPG Industries, Inc. of Pittsburgh, Pa., is sprayed upon grille surfaces to a dry film thickness of about 0.7 mils to 1.5 mils (17.8 $\mu$m to 38.1 $\mu$m). In an alternative embodiment, other known suitable primers and the like may be used within the scope of the invention. The conductive primer is reduced as necessary with a solvent, such as, for example, acetone or a 50/50 mixture of acetate and methyl ethyl ketone, to achieve an appropriate application viscosity, such as, for example 22 seconds #4 Ford Cup. Solvent reduction is further adjusted as necessary near the appropriate viscosity level to minimize runs and solvent blisters. The conductive primer is applied to grille 108 using known spray techniques and equipment, such as, for example, manual or automatic methods utilizing air atomized spray guns or high volume, low pressure (HVLP) spray guns. Once the conductive primer is applied to the grille surfaces, the primer is cured in an oven for approximately 20 minutes at 270° F. to 300° F. (132° C. to 149° C.).

After the primer is cured, grille surfaces are powder coated with a thermosetting polyester powder coating. The powder coating can include a polyester/urethane resin. Suitable powder coatings are highly cross-linked to produce adequate hardness, abrasion and chemical resistance, as well as color stable to ultraviolet light that enable grille 108 to withstand the demanding conditions associated with use in an oven environment, such as, for example, during operation of oven 100 (shown in FIGS. 1 and 2). Examples of suitable thermosetting polyester powder coatings are commercially available from Lilly Powder Coating of Kansas City, Mo., a division of Lilly Industries, Inc. of Bowling Green, Ky., and include:

| | |
|---|---|
| 325B | Black |
| 346W | White |
| 3300D7001 | Almond |
| 3300D8002 | Bisque |

Other resinous film forming materials, such as acrylic, polyether, and polyurethane materials or a mixture thereof could be combined with rheology control agents, ultraviolet light stabilizers catalysts, fillers, and the like and used within the scope of the present invention, provided that the resultant coating composition is not detrimentally affected in terms of physical performance and properties.

The powder coating is spray applied to louvers 140 using electrostatic powder guns after grille 108 is heat treated, or degassed, to remove volatiles which may outgas and cause surface defects as the powder coating is cured. The powder coating may be applied using automatic or manual spray methods. The powder coat is then cured by baking grille 108 at substantially the same temperature at which the primed grille was pre-heated or degassed.

It is contemplated that other conventional powder coating methods, including but not limited to fluidized bed applications and the like may also be used within the scope of the invention with or without primer coatings or layers underneath the powder coatings.

In one embodiment, grille 108 is degassed by baking grille 308 at 370° F. to 380° F. (188° C. to 193° C.) for at least about 15 minutes to about 30 minutes. The 325B Black powder coating is applied manually to grille louvers 140 using electrostatic powder coating spray guns at a setting of 35 kV to 44 kV. After the powder coating is manually applied to louvers 140, grille 108 is automatically powder coated using electrostatic powder coating spray guns at a setting of 60 kV to 90 kV. The powder coated grille 108 is oven cured for at least about 20 minutes at a temperature of about 370° F. to 380° F. (188° C. to 193° C.). The powder coating is applied to a thickness of approximately 1.5 mils to 2.5 mils (38.1 $\mu$m to 63.5 $\mu$m) on louvers 140, and to a thickness of approximately 3 mils to 5 mils (76.2 $\mu$m to 127 $\mu$m) on a remainder of the grille surface.

In another embodiment, grille 108 is degassed by baking grille 308 at 370° F. to 380° F. (188° C. 193° C.) for at least 5 minutes to about 15 minutes. The 346W White, 3300D7001 Almond, or 3300D8002 Bisque powder coating is manually applied to louvers 140 using electrostatic powder coating spray guns at a setting of 35 kV to 44 kV. After the powder coating is manually applied to louvers 140, grille 108 is automatically powder coated using electrostatic powder coating spray guns at a setting of 60 kV to 90 kV, and the powder coating is cured in an oven at 370° F. to 380° F. (188° C. to 193° C.) for approximately 20 minutes. The powder coating is applied to a thickness of approximately 1.5 mils to 2.5 mils (38.1 $\mu$m to 63.5 $\mu$m) on louvers 140, and to a thickness of approximately 3 mils to 5 mils (76.2 $\mu$m to 127 $\mu$m) on a remainder of the grille surface.

The above-described method was found to produce grease resistant grilles that were tested satisfactorily to the following specifications:

| | |
|---|---|
| Crosshatch Adhesion | 95% retention of coating after tape jerk with 3M 600 tape. |
| Steam Exposure | 2 hours without blistering, color change, or loss of adhesion |
| Chicken Grease Exposure | 24 hours at 275° F. (135° C.) without color or gloss change |
| Lard/CRISCO (50/50) Grease Exposure | 24 hours at 275° F. (135° C.) without color or gloss change |
| Humidity Exposure | 30 days at 100% relative humidity and 100° F. (43° C.)with no blistering, no color change, and no loss of adhesion |
| Dry Heat Exposure | 168 hours at 275° F. (135° C.) with color change and no loss of adhesion |

Therefore, an adequate oven grille is provided that is capable of withstanding a higher temperature environment than known oven grilles while resisting grease stains and color affects.

While the invention has been described in terms of various specific embodiments, those skilled in the art will recognize that the invention can be practiced with modification within the spirit and scope of the claims.

What is claimed is:

1. A grease resistant oven grille comprising:

an injection molded plastic structure having a plurality of air passages therethrough; and a grease resistant powder coating layer overlying said plastic structure.

2. An oven grille in accordance with claim 1 wherein said powder coating is configured to withstand oven exhaust temperatures of about 260° F. (127° C.) to about 325° F. (163° C.) without color change.

3. An oven grille in accordance with claim 2 wherein said powder coating is configured to withstand oven exhaust temperatures of about 275° F. (135° C.) without color change.

4. An oven grille in accordance with claim 1 wherein said plastic structure comprises a plurality of cross members, and at least one louver extending between said cross members.

5. An oven grille in accordance with claim 4 wherein said louver comprises a face, a inner extension extending substantially perpendicular from the base, and an inclined section extending obliquely from said inner extension.

6. An oven grille in accordance with claim 1 further comprising a primer layer between said plastic structure and said powder coating.

7. An oven grille in accordance with claim 6 wherein said primer layer has a dry film thickness of about 0.7 mils to about 1.5 mils (17.8 μm to 38.1 μm).

8. An oven grille in accordance with claim 7 wherein said primer is a conductive primer.

9. An oven grille in accordance with claim 1 wherein said powder coating has a thickness of about 1.5 mils to about 5 mils (38.1 μm to 127 μm).

10. An oven comprising;

a cooking cavity;

at least one radiant cooking unit for delivering cooking energy into said cooking cavity;

an exhaust system for ventilating said cooking cavity; and a plastic grille in flow communication with said exhaust system for passing exhaust air therethrough, said grille comprising a powder coated surface for resisting grease stains and color effects at exhaust temperatures of about 260° F. (127° C.) to about 325° F. (163° C.).

11. An oven in accordance with claim 10 wherein said grille powder coated surface is configured to withstand oven exhaust temperatures of about 275° F. (135° C.) without color change.

12. An oven in accordance with claim 10 wherein said oven grille comprises a plurality of cross members, and at least one louver extending between said cross members.

13. An oven in accordance with claim 12 wherein said grille louver comprises a face, an inner extension extending substantially perpendicular from said face, and an inclined section extending obliquely from said inner extension.

14. An oven in accordance with claim 10 further comprising a primer layer between said plastic structure and said powder coating of said grille.

15. An oven in accordance with claim 14 wherein said oven primer has a dry film thickness of about 0.7 mils to about 1.5 mils (17.8 μm to 38.1 μm).

16. An oven in accordance with claim 15 wherein said primer is a conductive primer.

17. An oven in accordance with claim 10 wherein said grille powder coating has a thickness of about 1.5 mils to about 5 mils (38.1 μm to 127 μm).

18. A method for fabricating a grease resistant oven grille, the grille including a plastic structure having an exterior surface and a plurality of passages therethrough, said method comprising the steps of:

applying a conductive primer to the exterior surface of the grille to a dry film thickness of about 0.7 mils to about 1.5 mils (17.8 μm to 38.1 μm);

curing the primed grille at a first temperature;

degassing the primed grille at a second temperature greater than the first temperature;

powder coating a portion of the exterior surface of the cured primed grille with a polyester powder coating, the portion including the plurality of passages;

powder coating an entire exterior surface of the cured primed grille with a polyester powder coating; and curing the polyester coating at a third temperature, the second temperature and the third temperature being approximately equal.

19. A method in accordance with claim 18 wherein said steps of powder coating comprise the step of electrostatically applying a powder coating to the primed grille to a thickness of about 1.5 mils to about 5 mils (38.1 μm to 127 μm).

20. A method in accordance with claim 18 wherein said step of curing the polyester powder coating comprises the step of heating the grille for about 20 minutes at a temperature of about 370° F. to about 380° F. (188° C. to 193° C.).

21. A method in accordance with claim 18 wherein said step of curing the primed grille comprises the step of heating the grille for about 20 minutes at about 270° F. to 300° F. (132° C. to 149° C.).

22. A method in accordance with claim 18 wherein said step of degassing the primed grille comprises the step of heating the grille for about 5 minutes to about 15 minutes at about 370° F. to about 380° F. (188° C. to 193° C.).

23. A method in accordance with claim 18 wherein said step of degassing the primed grille comprises the step of heating the grille for about 15 minutes to about 30 minutes at a temperature of about 370° F. to about 380° F. (188° C. to 193° C.).

* * * * *